US007448824B2

(12) United States Patent
Lipniarski

(10) Patent No.: US 7,448,824 B2
(45) Date of Patent: Nov. 11, 2008

(54) TRAFFIC BARRICADE HAVING INTERCHANGEABLE PARTS

(75) Inventor: David J. Lipniarski, North Tonawanda, NY (US)

(73) Assignee: Confer Plastics, Inc., North Tonawanda, NY (US)

( * ) Notice: Subject to any disclaimer, the term of this patent is extended or adjusted under 35 U.S.C. 154(b) by 0 days.

(21) Appl. No.: 12/040,033

(22) Filed: Feb. 29, 2008

(65) Prior Publication Data

US 2008/0213041 A1 Sep. 4, 2008

Related U.S. Application Data

(60) Provisional application No. 60/904,217, filed on Mar. 1, 2007.

(51) Int. Cl.
*E01F 8/018* (2006.01)
*E01F 9/012* (2006.01)

(52) U.S. Cl. ..... 404/6; 404/9; 116/63 P

(58) Field of Classification Search ..... 404/6, 404/9; 116/63 P; 40/612; 256/13.1
See application file for complete search history.

(56) References Cited

U.S. PATENT DOCUMENTS 2,235,282 A * 3/1941 Carver ..... 248/472
3,880,406 A 4/1975 Stehle et al.
3,950,873 A 4/1976 Stehle et al.
4,038,769 A * 8/1977 Werner ..... 40/610
4,190,379 A * 2/1980 Toro Sosa et al. ..... 404/6
4,253,260 A * 3/1981 Maza et al. ..... 40/610
4,298,186 A 11/1981 Glass
D278,416 S * 4/1985 Moran ..... D10/109
4,624,210 A 11/1986 Glass
4,974,815 A 12/1990 Glass
5,362,020 A * 11/1994 Brown ..... 248/166
6,616,368 B2 9/2003 Birchler et al.
2002/0059893 A1* 5/2002 Kim ..... 116/63 T
2005/0069383 A1* 3/2005 Gunderson ..... 404/6

FOREIGN PATENT DOCUMENTS

GB 2322149 * 8/1998

* cited by examiner

*Primary Examiner*—Gary S Hartmann
(74) *Attorney, Agent, or Firm*—Roach Brown McCrathy & Gruber, P.C.; Kevin D. McCarthy

(57) ABSTRACT

The present invention is directed to traffic barricade having interchangeable base members and upright members that interconnect to each other. The base member and upright member are identical which allows the base member and the upright member to be interchanged together.

3 Claims, 4 Drawing Sheets

TRAFFIC BARRICADE HAVING INTERCHANGEABLE PARTS

CLAIM OF PRIORITY

This application claims priority to U.S. provisional patent application Ser. No. 60/904,217, filed on Mar. 1, 2007.

FIELD OF THE INVENTION

The present invention is directed to a traffic barricade design, and in particular to a plastic traffic barricade design.

BACKGROUND OF THE INVENTION

Traffic barricades are commonly used to warn vehicle traffic and pedestrians of danger and block off restricted areas. A traffic barricade is typically a portable or fixed device having from one to three rails with appropriate markings. It is used to control traffic by closing, restricting, or delineating all or a portion of the right-of-way.

The Manual on Uniform Traffic Control Devices (MUTCD) classifies barricades as belonging to one of three types: Type I, Type II, or Type III. Type I or Type II barricades are intended for use in situations where traffic is maintained through the temporary traffic control zone. They may be used singly or in groups to mark a specific condition, or they may be used in a series for channeling traffic. Type I barricades normally would be used on conventional roads or urban streets and arterials. Type II barricades have more retroreflective area and are intended for use on expressways and freeways or other high-speed roadways. Type III barricades are used at a road closure. They may extend completely across a roadway or from curb to curb. Where provision is made for access of authorized equipment, vehicles, and/or local traffic, it is often necessary to move the barricade between a position blocking traffic and a position permitting traffic.

Barricades made of molded plastic have been known for some time. Examples are found in U.S. Pat. Nos. 3,880,406 and 3,950,873 to Stehle et al. and U.S. Pat. Nos. 4,298,186 and 4,624,210 to Glass. Barricades illustrated in these patents include two panel units hinged together so that they can be spread apart for use and collapsed for storage or transport—a conventional A-frame barricade. The individual panel units are one piece, integral, hollow plastic panels, formed by rotational or blow molding. The lower hollow sections may contain ballast.

Those plastic traffic barricades were an improvement over conventional steel and wood barricades. They are rugged, yet cause less damage to vehicles if inadvertently struck. Through the use of ballast in the units the center of gravity of the barricade is lower than either wood or metal barricades. The result is a barricade less susceptible to being blown over by wind. Other features typically incorporated in such barricades are bright colored reflective horizontal panels, flashing lights or signs, and a structural member near the bottom where a sand bag can be placed if additional ballast is required.

Plastic traffic barricades normally come in two conventional and distinct designs. The first conventional traffic barricade design is the A-frame design, an example of which is illustrated at U.S. Pat. No. 4,974,815. The second conventional traffic barricade design is a T-frame design, an example of which is illustrated at U.S. Pat. No. 6,616,368.

A first T-frame barricade design 10 is illustrated at FIG. 1. The T-frame barricade design 10 has two base horizontal members 12*a*, 12*b*; two support vertical members 14*a*, 14*b*; and a plurality of perpendicular rails 16 that interconnect to the two support vertical members 14*a*, 14*b*. Each support vertical members 14*a*, 14*b* connects to a respective base horizontal member 12*a*, 12*b*; and each perpendicular member securely fastens to the support vertical members.

Another embodiment of a T-frame barricade design 100 is illustrated at FIG. 2. The second embodiment has a base 120 which supports an upright member 140. The base 120 includes two removably interlocking sections 122, each having an enlarged portion. The enlarged portions define a socket 124 for closely receiving a tab 142 extending from the upright member 140. A deformably resilient material 126 surrounds the socket 122, permitting the upright member to deflect slightly and return to a substantially perpendicular orientation relative to the base 120. The upright member 140 incorporates integral structural supports which permit the barricade upright member 140 to maintain an upright member orientation without additional external support mechanisms.

The A-frame barricade design 20 is illustrated at FIG. 3. The A-frame barricade design 20 has two sets of leanable support members 22*a*, 22*b*, 24*a*, 24*b*, a plurality of perpendicular members 26 that interconnect to at least one member of both sets of leanable support members 22*a* and 24*a* and/or 22*b* and 24*b*, and a hinge rod 28 that interconnects (a) leanable support member 22*a* to leanable support member 24*a* and (b) leanable support member 22*b* to leanable support member 24*b*.

The T-frame barricade designs 10, 100 and the A-frame barricade design 20 have problems. One of those problems is that if these barricade designs are hit by a vehicle, which is common, the barricade 10, 100, 20 has to be reconstructed, at least in part, with new components since each component only connects to a different part in one specific manner. That problem raises costs on road projects, which may be why no one has developed a more efficient barricade design.

This problem can be solved by the current invention.

SUMMARY OF THE INVENTION

The present invention is directed to a traffic barricade having interchangeable base members and upright members that interconnect to each other. The base member and upright member are identical in shape, male interconnects and female interconnects. That identicalness allows the base member and the upright member to be interchanged together.

BRIEF DESCRIPTION OF THE DRAWINGS

The invention may take physical form in certain parts and arrangements of parts, and in various steps and arrangements of steps. The drawings are only for purposes of illustrating the preferred embodiments and are not to be construed as limiting the invention.

DETAILED DESCRIPTION OF THE INVENTION

Figure 3:
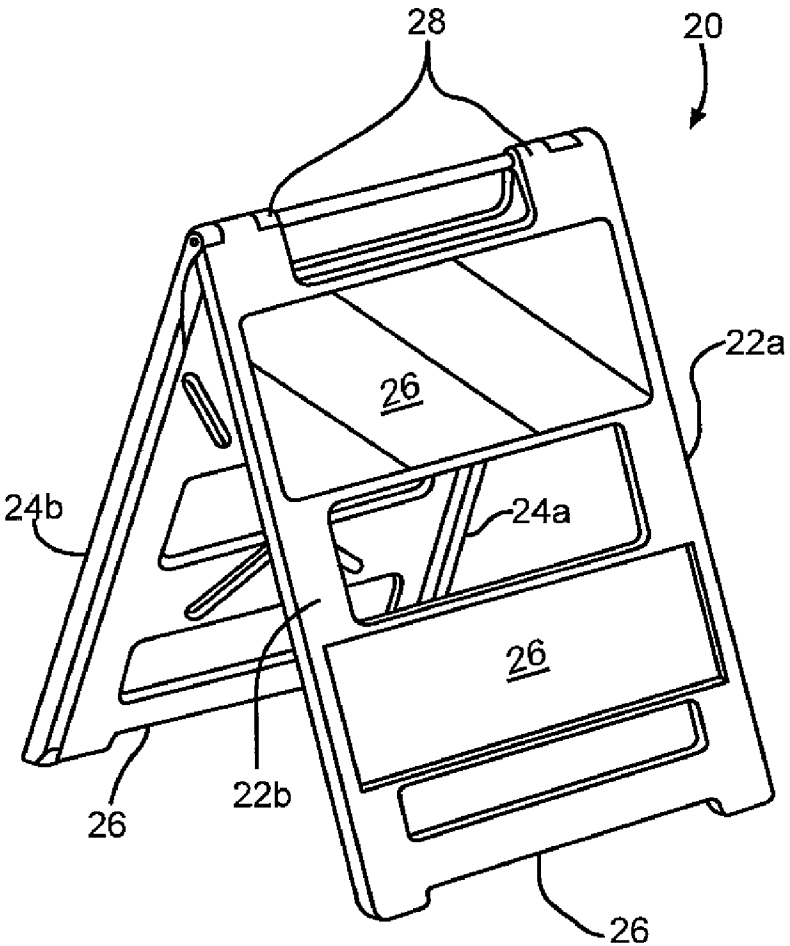
FIG. 3 (Prior Art)
FIG. 3 illustrates a prior art embodiment of an A-frame barricade design.
Figure 1:
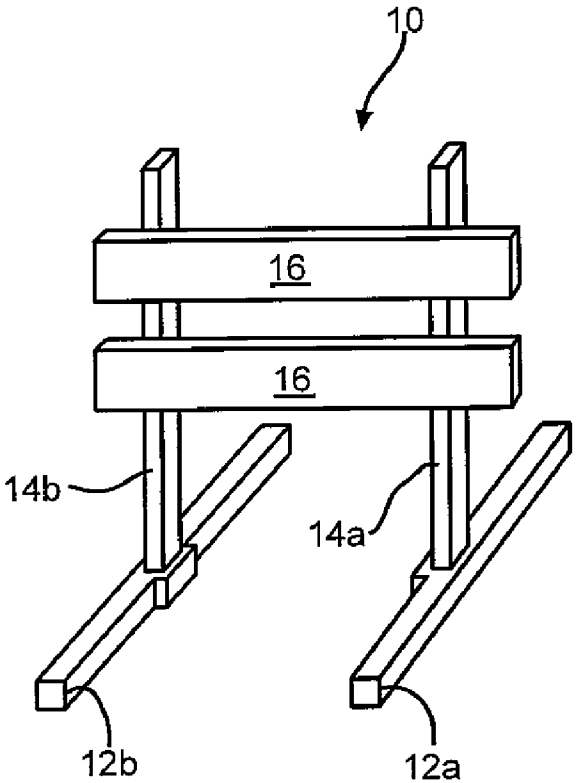
FIG. 1 (Prior Art)
FIG. 1 illustrates a prior art embodiment of a T-frame barricade design.
Figure 2:
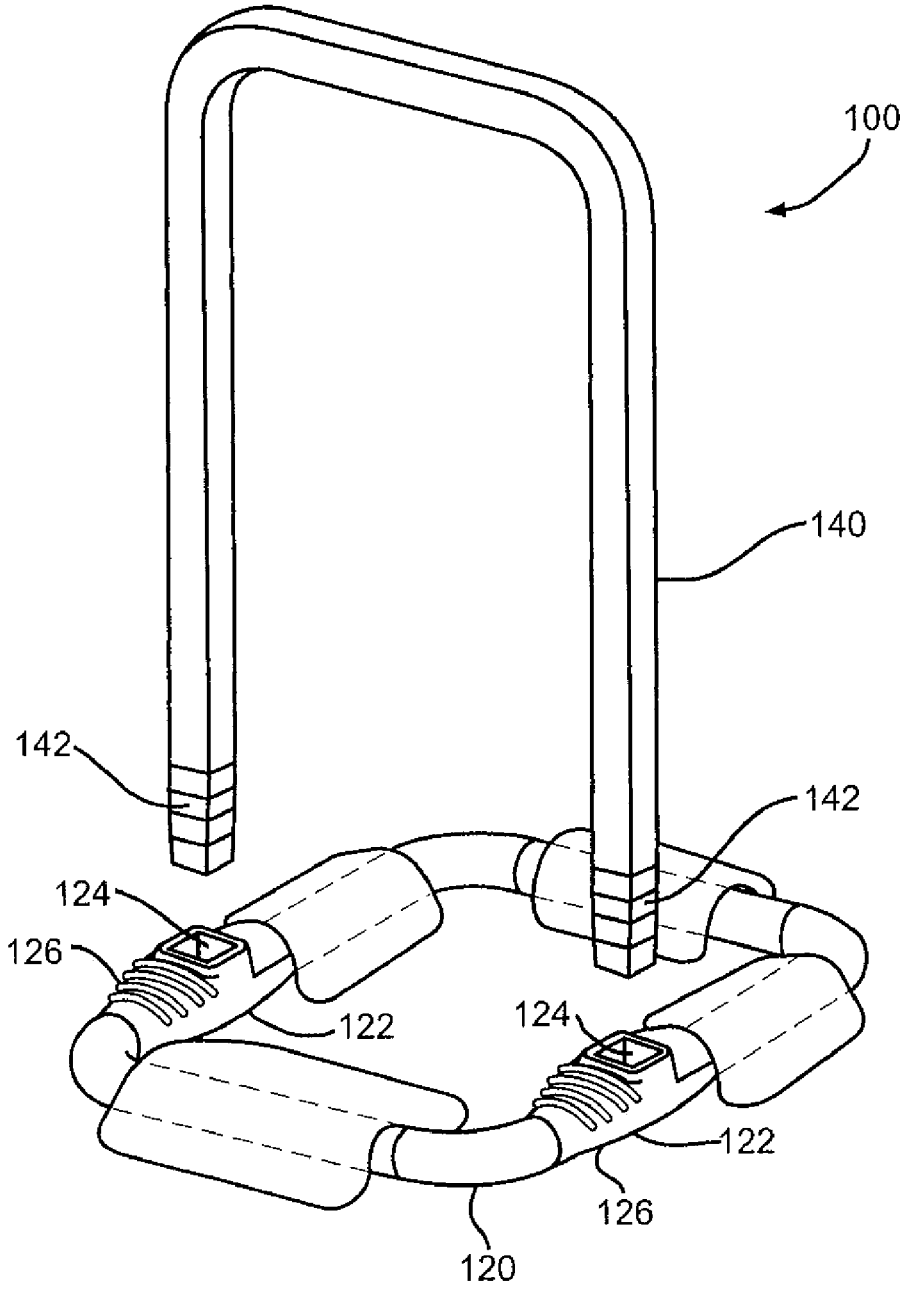
FIG. 2 (Prior Art)
FIG. 2 illustrates an alternative prior art embodiment of a T-frame barricade design.
Figure 4:
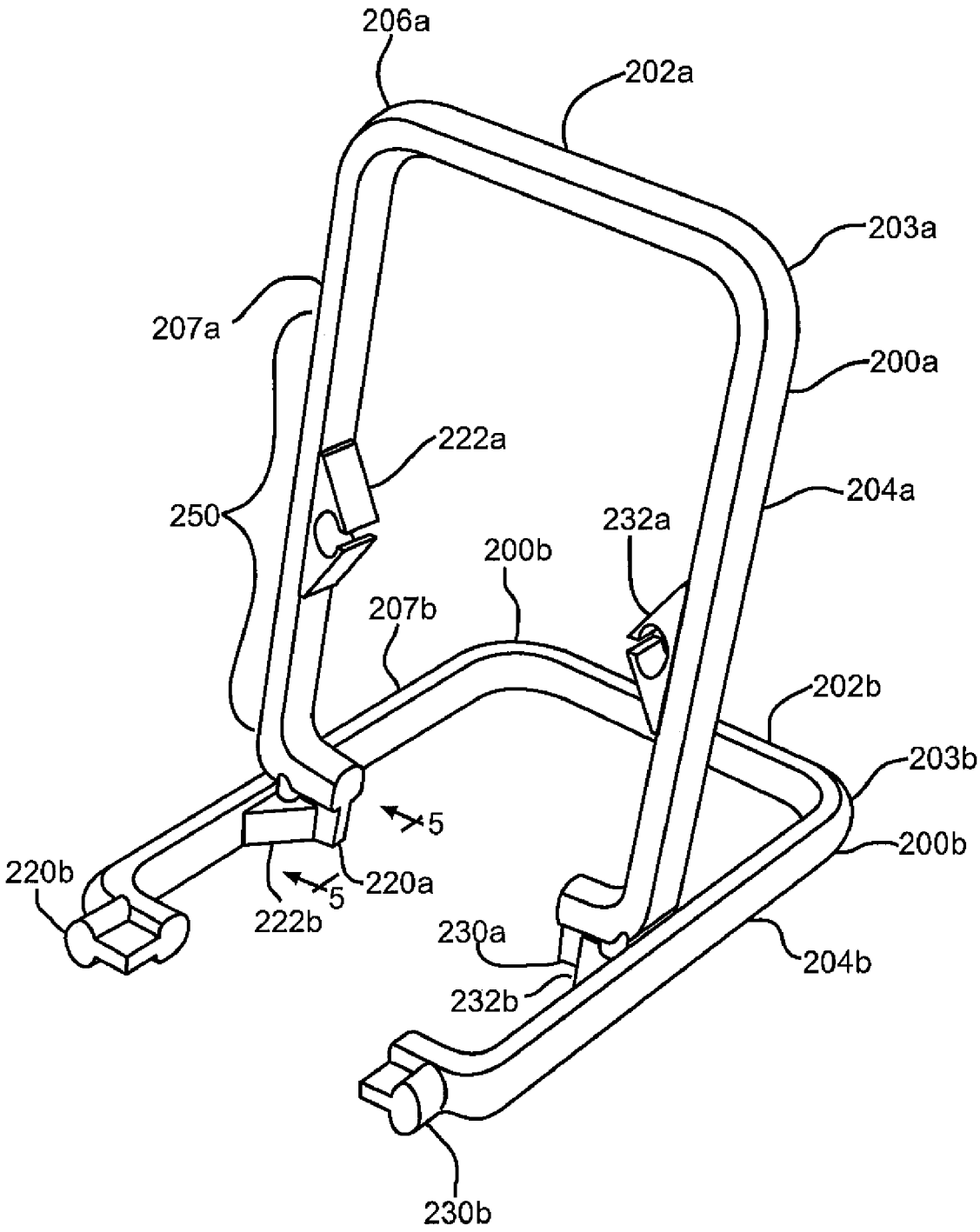
FIG. 4 illustrates an embodiment of the current invention.

FIG. 4 illustrates two identical and interchangeable base/upright members 200*a*, 200*b*. Each base/upright member 200*a*, 200*b* is shaped like the letter "U".

Each identical U-shape base/upright member 200 has a horizontal support bar 202—sometimes referred to as the bottom part of the letter U. The horizontal support bar 202 has a first end 203 and a second end 206. Extending from first end 203 is a first vertical support bar 204, and extending from the second end 206 is a second vertical support bar 207. The first vertical support bar 204 and the second vertical support bar 206 are in the same plane in relation to the horizontal support bar 202.

Each base/upright member 200 interconnects to another base/upright member 200. To accomplish this interchangeable interconnection, the first vertical support bar 204 has a first terminal male end 230 and a first middle area female interconnect 232. Likewise, the second vertical support bar 207 has a second terminal male end 220 and a second middle area female interconnect 222. That way, the first base/upright member 200*a* interconnects to the second base/upright member 200*b* in the following manner:

First terminal male end 230*a* of the first base/upright member 200*a* interconnects to (a) the first middle area female interconnect 232*b* of the second base/upright member 200*b*, as illustrated in FIG. 4; or (b) the second middle area female interconnect 222*b* of the second base/upright member 200*b;*

Second terminal male end 220*a* of the first base/upright member 200*a* interconnects to (a) the second middle area female interconnect 222*b* of the second base/upright member 200*b*, as illustrated in FIG. 4; or (b) the first middle area female interconnect 232*b* of the second base/upright member 200*b*.

Alternatively, the second base/upright member 200*b* interconnects to the first base/upright member 200*a* in the following manner:

First terminal male end 230*b* of the second base/upright member 200*b* interconnects to (a) the first middle area female interconnect 232*a* of the first base/upright member 200*a*; or (b) the second middle area female interconnect 222*a* of the first base/upright member 200*a;*

Second terminal male end 220*b* of the second base/upright member 200*b* interconnects to (a) the second middle area female interconnect 222*a* of the first base/upright member 200*a*; or (b) the first middle area female interconnect 232*a* of the first base/upright member 200*a*.

By having such universal interconnection capabilities, the first and second base/upright members 200 can be interchanged with each other. This interchangeability allows the base/upright members 200 to be the base portion or the upright portion. That way, when a base/upright member is contacted by a vehicle, then the damaged base/upright member can be fixed or replaced without having to have an inventory of numerous specific parts—you only need one set of parts for the base and upright members.

Each female interconnect 222, 232 is positioned somewhere in the middle area 250 of each vertical support bar 204*a,b*, 207*a,b*. The female interconnect is located in the identical position for each vertical support bar 204*a,b*, 207*a,b*, and to provide the maximum support to the upright member. That maximum support is designed to allow the barricade to be less susceptible to being blown over by wind.

Figure 6:
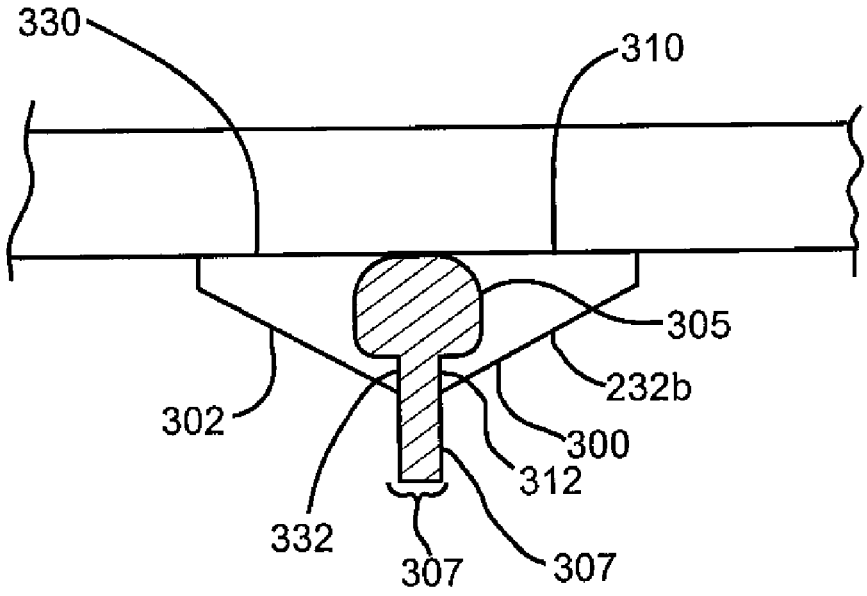
FIG. 6 illustrates FIG. 5 taken along the lines 6-6.

Each female interconnect 222*a,b*, 232*a,b*, as best illustrated at FIG. 6, has a receiving aperture 305 and a gap aperture 307 defined by a first extension 300 and a second extension 302. The first extension 300 has a proximal end 310 that protrudes from the vertical support bar toward the terminal male end and a distal end 312 positioned a distance from the vertical support bar. Likewise, the second extension 302 has a proximal end 330 that protrudes from the vertical support bar toward (a) the horizontal support bar 202 and the distal end 312 of the first extension 300, and (b) a distal end 332 positioned the distance from the vertical support bar. The space between the distal ends 332, 312 defines the gap aperture 307. The receiving aperture 305 is defined by (a) the remainder of the first extension 300 and the second extension 302, and (b) the vertical support bar. The receiving aperture 305 can be any shape. As illustrated in FIG. 4, the receiving aperture 305 and gap aperture 307 make the aperture complex 300, 302, 305, 307 look like a spade.

Figure 5:
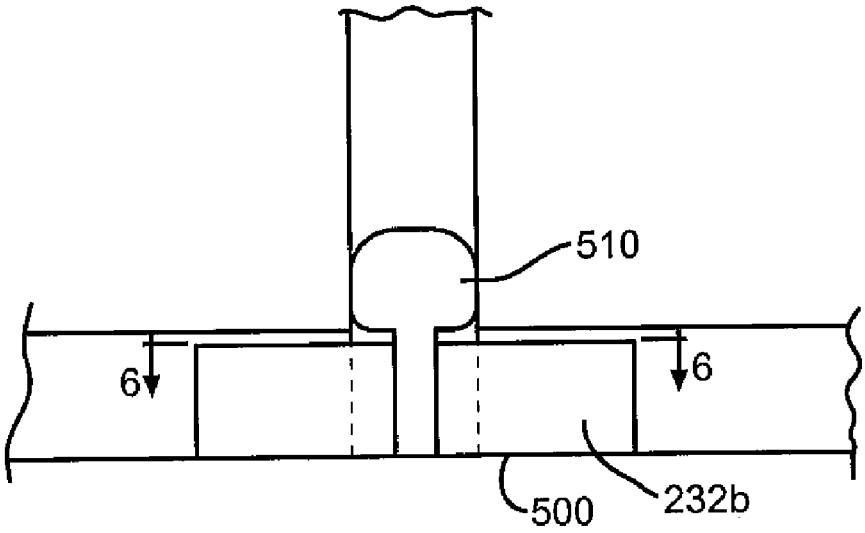
FIG. 5 illustrates an embodiment of FIG. 4 when interconnected together taken along the lines 5-5.

What ever the shape of the aperture complex 300, 302, 305, 307, the terminal male end is shaped to fit into the aperture complex 300, 302, 305, 307, as illustrated in FIGS. 4, 5, and 6, and have a portion contact the ground end 500 of the aperture complex. Contacting the ground secures the terminal male end in place. The terminal male end is further secured in place by having a weight bearing member 510 positioned over the aperture complex 300, 302, 305, 307. The weight bearing member 510 is a hollowed area that is positioned immediately above the aperture complex 300, 302, 305, 307. The weight bearing member 510 can be filled with liquids (for example water), solids (for example sand and/or dirt) or combinations thereof to provide the desired weight to the structures 200*a*, 200*b* upon each other.

The base/upright members 200*a*, 200*b* are made of plastic material. The plastic material can be blow-molded. The plastic material can have an aperture (not shown) that allows filling or partially filling the members 200*a*, 200*b* with liquid, solids and/or combinations thereof.

Conventional perpendicular rail members could be attached to the base/upright members 200*a*, 200*b*. Alternatively, plastic sheets, with and without wind apertures, can be positioned over the upright member. The plastic sheets can have the desired reflectors and/or colors thereon to provide the desired warning to drivers.

Other features of the plastic cover, rails, and barricades incluse bright colored reflective horizontal panels, and flashing lights or signs.

The present invention provides a more efficient means to create and set up traffic barriers; and, fix, repair and replace broken traffic barriers. The individual merely has to interconnect two identical base/upright members and place the desired warning signal on or over the upright member.

The invention has been described with reference to the preferred embodiment. Modifications and alterations will occur to others upon a reading and understanding of the preceding detailed description. These modifications and alterations include continued variety in the size of the illustrated components, both in width and height, presence or absence of a light fixture, manufacturing techniques used, and attachment devices employed between various components as illustrated. It is intended that the invention be construed as including all such modifications and alterations insofar as they come within the scope of the appended claims or the equivalents thereof.

I claim:

1. A barricade comprising: a U-shaped base member which supports an identical U-shaped upright member in a generally vertical orientation, each base member and upright member has a horizontal support bar having a first end and a second end, extending from first end is a first vertical support bar, extending from the second end is a second vertical support bar;

the first vertical support bar and the second vertical support bar are in the same plane in relation to the horizontal support bar, and each vertical support bar has an identical terminal male end;

a female interconnect (a) positioned at the identical position on each vertical support bar and (b) having a receiving aperture and a gap aperture defined by a first extension and a second extension wherein the first extension protrudes from the vertical support bar toward the terminal male end of that vertical support bar and the second extension has a proximal end that protrudes from the vertical support bar toward the horizontal support bar, the distance at distal ends between the first extension and the second extension defines the gap aperture, the receiving aperture is defined by the remainder of the first extension and the second extension;

the terminal male end of the upright member interconnects with the female interconnect of the base member.

2. The barricade of claim 1, further including: at least one cross member which interconnects generally vertical leg members of upright member, the cross member displacing a warning or instruction to road users.

3. The barricade of claim 1, further including: a warning light mounted to a top portion of the U-shaped upright member.

* * * * *